United States Patent [19]

Goffe

[11] 4,081,273

[45] Mar. 28, 1978

[54] MIGRATION IMAGING METHOD

[75] Inventor: William L. Goffe, Webster, N.Y.

[73] Assignee: Xerox Corporation, Stamford, Conn.

[21] Appl. No.: 54,526

[22] Filed: Jul. 13, 1970

Related U.S. Application Data

[63] Continuation-in-part of Ser. No. 327, Jan. 2, 1970, abandoned, Ser. No. 854,596, Sep. 2, 1969, Ser. No. 837,780, Jun. 30, 1969, and Ser. No. 460,377, Jun. 1, 1965, Pat. No. 3,520,681. Said Ser. No. 327, is a continuation-in-part of said Ser. No. 854,596 and said Ser. No. 837,780 is a continuation-in-part of said Ser. No. 460,377 and Ser. No. 725,676, May 1, 1968, abandoned, and Ser. No. 483,675, Aug. 30, 1965. Said Ser. No. 725,676 is a continuation-in-part of said Ser. No. 460,377 and said Ser. No. 483,675, and Ser. No. 403,002, Aug. 12, 1964, abandoned. Said Ser. No. 460,377 and Ser. No. 483,675 is a continuation-in-part of said Ser. No. 403,002.

[51] Int. Cl.[2] ..... G03G 13/22; G03G 13/12

[52] U.S. Cl. ..... 96/1 PS; 427/13; 427/26; 427/145; 427/161

[58] Field of Search ..... 96/1, 1.3, 1 R, 1.5, 96/1.8; 250/49.5; 117/17.5, 37 LE; 204/181

[56] References Cited

U.S. PATENT DOCUMENTS

| | | | |
|---|---|---|---|
| 2,297,691 | 10/1942 | Carlson | 96/1 R |
| 2,953,470 | 9/1960 | Green et al. | 96/1 R |
| 3,322,538 | 5/1967 | Redington | 96/1 R |
| 3,384,566 | 5/1968 | Clark | 204/181 |
| 3,394,002 | 7/1968 | Bickmore | 96/1 |
| 3,438,772 | 4/1969 | Gundlach | 96/1 |
| 3,453,106 | 7/1969 | Teogne | 96/1.5 |
| 3,485,738 | 12/1969 | Carreira | 204/181 |
| 3,511,651 | 5/1970 | Rosenberg | 96/1.5 |
| 3,512,968 | 5/1970 | Tulagen | 96/1.2 |
| 3,520,681 | 7/1970 | Goffe | 96/1 R |
| 3,595,770 | 7/1971 | Luebbe et al. | 96/1 PE |
| 3,656,990 | 4/1972 | Goffe | 96/1 R |

FOREIGN PATENT DOCUMENTS

| | | |
|---|---|---|
| 7,504 | 10/1965 | United Arab Emirates. |

*Primary Examiner*—Roland E. Martin, Jr.

[57] ABSTRACT

A migration imaging system wherein migration imaging members typically comprising a substrate, a layer of softenable material, and migration marking material, additionally comprises an overlayer of electrically conductive material which is electrically connected to electrically charge the imaging member.

53 Claims, 8 Drawing Figures

MIGRATION IMAGING METHOD

CROSS-REFERENCE TO RELATED APPLICATIONS

This application is a continuation-in-part of my copending U.S. patent applications (1) Ser. No. 327, filed Jan. 2, 1970 now abandoned; (2) Ser. No. 854,596, filed Sept. 2, 1969; (3) Ser. No. 837,780, filed June 30, 1969: and (4) Ser. No. 460,377, filed June 1, 1965 now U.S. Pat. No. 3,520,681. Application (1) is a continuation-in-part of my copending applications (2) and (3). Application (3) is a continuation-in-part of my applications (4), (5) Ser. No. 725,676, filed May 1, 1968, now abandoned, and (6) Ser. No. 483,675, filed Aug. 30, 1965; application (5) being a continuation-in-part of (4) and (6) and application Ser. No. 403,002, filed Oct. 12, 1964 (403,002 pending when (5) was filed but 403,002 now abandoned); (4) and (6) both being continuations-in-part of 403,002.

BACKGROUND OF THE INVENTION

This invention relates in general to imaging, and more specifically to migration imaging systems employing overcoated migration imaging members having an overlayer of electrically conductive material.

Recently, a migration imaging system capable of producing high quality images of high density, continuous tone, and high resolution has been developed. Such migration imaging systems are disclosed in copending applications Ser. No. 837,780, filed June 30, 1969, and Ser. No. 837,591, filed June 30, 1969. In a typical embodiment of the new migration imaging system an imaging member comprising a substrate, a layer of softenable material and photosensitive marking material is latently imaged by electrically charging the member and exposing the charged member to a pattern of activating electromagnetic radiation such as light. Where the photosensitive marking material was originally in the form of a fracturable layer at the upper surface of the softenable layer, the marking particles in the exposed areas of the member migrate toward the substrate when the member is developed by softening the softenable layer.

"Softenable" as used herein is intended to mean any material which can be rendered more permeable thereby enabling particles to migrate through its bulk. Conventionally, changing the permeability of such material or reducing its resistance to migration of migration marking material, is accomplished by heat or solvent softening. "Fracturable" layer or material as used herein, means any layer or material which is capable of breaking up during development, thereby permitting portions of said layer to migrate toward the substrate or to be otherwise removed. The fracturable layer may be particulate, semi-continuous, or continuous in various embodiments of the migration imaging members.

There are various other systems for forming such images, wherein non-photosensitive or inert, marking materials are arranged in the aforementioned fracturable layers, or dispersed throughout the softenable layer, as described in the aforementioned copending applications which also disclose a variety of methods which may be used to form latent images upon such migration imaging members.

Likewise, various means for developing latent images in the novel migration imaging system are known. Typical development methods include solvent wash-away; solvent vapor softening, heat softening and combinations of these methods, although any suitable means for migration developing the imaging member is intended to be included herein. In the solvent wash-away method, the layer of softenable material is typically substantially washed away, leaving behind an image pattern of migrated marking material on the substrate. In the heat or vapor softening modes, the softenable layer is softened to allow imagewise migration of marking material toward the substrate and the developed imaged member generally comprises the substrate having migrated marking particles near the softenable layer-substrate interface, with the softenable layer and unmigrated marking materials intact on the substrate in substantially their original condition.

Various methods and materials and combinations thereof have previously been used to fix unfixed migration images. For example, fixing methods and materials previously used are disclosed in copending applications Ser. No. 590,959, filed Oct. 31, 1966, and Ser. No. 695,214, filed Jan. 2, 1968.

Copending application Ser. No. 172, filed Jan. 2, 1970, discloses novel migration imaging systems using migration imaging members having one or more overlayers of material which enhance the imaging systems. Such overlayers may comprise another layer of softenable material, a layer of material which is harder than the softenable material layer, or a gelatin layer.

In new and growing areas of technology such as the migration imaging systems of the present invention, new methods, apparatus, compositions of matter, and articles of manufacture continue to be discovered for the application of the new technology in new modes. The present invention relates to a new and advantageous migration imaging system employing overcoated imaging members having an overlayer of electrically conductive material thereon.

SUMMARY OF THE INVENTION

It is, therefore, an object of this invention to provide a novel migration imaging system.

It is another object of this invention to provide novel migration imaging members.

It is another object of this invention to provide novel methods for imaging and especially novel methods for electrically charging migration imaging members.

It is a further object of this invention to provide a novel migration imaging member and system wherein the imaging members are protected from external destructive forces such as abrasion, fingerprinting, dusting and the like, both before and after imaging.

It is still another object of this invention to provide an imaging system capable of producing opaque, translucent or even transparent imaged members, the latter resembling photographic film and microfilm in some embodiments.

The foregoing objects and others are accomplished in accordance with this invention wherein migration imaging systems are used in conjunction with migration imaging members having an overlayer of electrically conductive material which is electrically connected to electrically charge the imaging member.

BRIEF DESCRIPTION OF THE DRAWINGS

For a better understanding of the invention as well as other objects and further features thereof reference is made to the following detailed description of preferred embodiments of the invention taken in conjunction with the accompanying drawings thereof, wherein.

DESCRIPTION OF THE PREFERRED EMBODIMENTS

Figure 1:
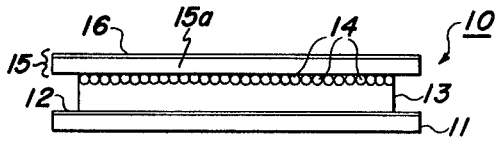
FIG. 1 is a partially schematic, cross-sectional view of a preferred embodiment of the layered configuration migration imaging member of the present invention.
Figure 2:
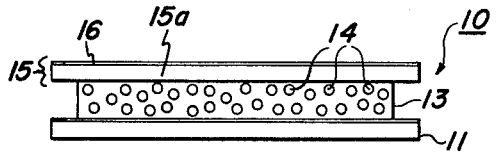
FIG. 2 is a partially schematic, cross-sectional view of a preferred embodiment of the bindered configuration migration imaging member of the present invention.

Migration imaging members preferred for use in the novel migration imaging processes of the present invention are illustrated in FIGS. 1 and 2. In the migration imaging member 10, illustrated in FIG. 1, the member comprises substrate 11 having a layer of softenable material 13 coated thereon, and the layer of softenable material 13 has a fracturable layer of migration marking material 14 contiguous the upper surface of softenable layer 13. In various embodiments, the supporting substrate 11 may be electrically insulating, electrically conductive or partially electrically conductive. In still other embodiments, electrically conductive substrate 11 may comprise a supporting substrate 11 having a conductive coating 12 coated onto the surface of the supporting substrate upon which the softenable layer 13 is also coated. The substrate 11 may be opaque, translucent, or transparent in various embodiments including embodiments wherein the electrically conductive layer 12 coated thereon may itself be partially or substantially translucent or transparent. The fracturable layer of marking material 14 contiguous the upper surface of softenable layer 13 may be coated onto, or slightly, partially, or substantially embedded in softenable material 13 at the upper surface of the softenable layer.

In addition, here the imaging members have electrically conductive overlayer 15 which is useful in electrically charging the member in migration imaging processes. Overlayer 15, in contact with the imaging member, may itself be electrically conductive, or the layer 15 may be made up of a more electrically insulating layer 15A with an outer coating 16 which is electrically conductive. Either configuration of the conductive overlayer performs quite satisfactorily in the advantageous system of the present invention. In various embodiments, the electrically conductive overlayer 15 may be opaque, translucent, or transparent, as desired. Also, in various embodiments, the conductive layer 15 may perform satisfactorily in a semi-continuous pattern, e.g. a Swiss cheese pattern, or in any desired image pattern. When the conducting layer 15 is shaped in a desired image pattern, either the electrically conductive overlayer 16, less electrically conductive layer 15A, or both layers 15A and 16 congruently, may be shaped in the desired image configuration.

In FIG. 2 preferred migration imaging member 10 also comprises supporting substrate 11 having softenable material layer 13 coated thereon. However, in this configuration the migration marking material 14 is dispersed throughout softenable layer 13 in a binder structured configuration. As in the layered configuration embodiment, the substrate may be opaque, translucent, or transparent, electrically insulating or electrically conductive. Advantageous electrically conductive overlayer 15 may take any of the configurations or embodiments suggested above with equally satisfactory results when used in conjunction with the binder structure described in FIG. 2.

Copending applications in Ser. No. 837,780, filed June 30, 1969, and Ser. No. 837,591, filed June 30, 1969, describe layered and binder-type migration imaging systems suitable for use in the present invention in great detail, and all the disclosure therein, and especially the disclosure relating to such imaging processes, imaging members and materials suitable for use in the migration imaging members used therein, is hereby incorporated by reference in the present specification.

The materials suitable for use as substrates 11, softenable layers 13, and migration marking materials 14, are typically the same materials disclosed in the aforementioned copending applications which are incorporated by reference herein. As stated above, the substrate 11 may be opaque, translucent, transparent, electrically insulating or electrically conductive. Similarly, the substrate and the entire migration imaging member which it supports may be in any suitable form including a web, foil, laminate or the like, strip, sheet, coil, cylinder, drum, endless belt, endless mobius strip, circular disk or other shape. The present invention is particularly suitable for use in any of these configurations.

In various embodiments of the novel migration imaging members of the present invention, the migration marking material may be electrically photosensitive, photoconductive, photosensitively inert, magnetic, electrically conductive, electrically insulating, or possess any other desired physical property and still be suitable for use in the present migration imaging system. As described in the incorporated disclosures, particles of the migration marking material suitable for use in the present invention are preferably of average size not greater than about 2 microns. Submicron particles give an even more satisfactory result, with an optimum range of particle size comprising particles of average size not greater than about 0.7 microns. When the migration marking material is arranged in a fracturable layer contiguous the surface of the softenable material spaced apart from the substrate, such fracturable layers are preferably of thicknesses in the range between about 0.01 to about 2.0 microns, although fracturable layers of thicknesses of about 5 microns have been found to give good results in various embodiments.

Similarly, the layer of softenable material 13 typically may comprise any substantially electrically insulating softenable material including a host of plastic or thermoplastic materials, a large number of which are specifically recited in the aforementioned copending applications; paraffins and waxes; and any other material which is typically substantially electrically insulating, and softenable by any suitable means when used in the advantageous system of the present invention. The softenable material may also be electrically photosensitive, photoconductive, photosensitively inert, substantially electrically insulating, more semi-conductive or electrically conductive, or have other desired properties depending upon its specific use in various other embodiments. Such softenable layers are preferably of thicknesses in a range between about ½ micron and about 16 microns, and softenable layers of thicknesses between about 1 and about 4 microns provide optimum imaging results.

The advantageous conductive overlayer 15 may comprise any suitable electrically conductive material including, for example, copper, brass, nickel, zinc, chromium, stainless steel, conductive plastics and rubbers, aluminum, steel, cadmium, silver, gold, or paper rendered conductive by the inclusion of a suitable material therein or, for example, through conditioning in a humid atmosphere to insure the presence therein of sufficient water content to render the material conductive, or any combination of the above materials. The conductive portion of layer 15 need only be sufficiently thick to allow lateral conduction of electrical changes.

In addition, the conductive overlayer 15 may comprise a less electrically conductive layer 15A overcoated by another coating of conductive material 16. This embodiment resembles the overcoated migration imaging structure described in copending application Ser. No. 172, filed Jan. 2, 1970, with an additional overlayer of conductive material. In such embodiments, the first overlayer may comprise any suitable material, including, for example, materials in the classes of polystyrenes, alkyd substituted polystyrenes, polyolefins, styrene-acrylate copolymers, styrene-olefin copolymers, silicone resins, phenolic resins, amorphous glasses and others. Such materials more particularly include Staybelite Ester 10, a partially hydrogenated rosin ester, Foral Ester, a hydrogenated rosin triester, and Neolyne 23, an alkyd resin, all from Hercules Powder Co.; SR type silicone resins aviailable from General Electric Corporation; Sucrose Benzoate, Eastman Chemical; Velsicol X-37, a polystyrene-olefin copolymer from Velsicol Chemical Corporation; Hydrogenated Piccopale 100, a styrene-vinyl toluene copolymer, Piccolastic A-75, 100 and 125, all polystyrenes, Piccodiene 2215, a polystyrene-olefin copolymer, all from Pennsylvania Industrial Chemical Corp.; Araldite 6060 and 6071, epoxy resins from Ciba; Amoco 18, a polyalphamethylstyrene from Amoco Chemical Corp.; R5061A, a phenylmethyl silicone resin and M-140, a custom synthesized styrene-co-n-butylmethacrylate, from Dow Corning; Epon 1001, a bisphenol A-eipchlohydrin epoxy resins, from Shell Chemical Corp.; and PS-2, PS-3, both polystyrenes, and ET-693, and Amberol ST, phenol-formaldehyde resins; ethyl cellulose, and Dow C4, a methylphenylsilicone, all from Dow Chemical; a custom synthesized 80/20 mole percent copolymer of styrene and hexylmethacrylate having an intrinsic viscosity of 0.179 dl/gm; other copolymers of styrene and hexylmethacrylate, a custom synthesized polydiphenylsiloxane; a custom synthesized polyadipate, acrylic resins available under the trademark Acryloid from Rohm & Haas Co., and available under the trademark Lucite from the D. E. duPont de Nemours & Co.; thermoplastic resins available under the trademark Pliolite from the Goodyear Tire & Rubber Co.; a chlorinated hydrocarbon available under the trademark Aroclor from Monsanto Chemical Co.; thermoplastic polyvinyl resins available under the trademark Vinylite from Union Carbide Co.; other thermoplastics disclosed in Gunther et al, U.S. Pat. No. 3,196,001; waxes and blends, mixtures and copolymers thereof. Overlayer materials may also include Bavick 11, a copolymer of alpha methylstyrene and methyl methacrylate from J. T. Baker Co.; Mylar, a polyester resin available from duPont, Elvacite, an acrylic resin from duPont; and others as well as mixtures and copolymers thereof.

The layer **15*a* may also comprise a suitable gelatin; for example, suitable grades of gelatins include edible, photographic, technical, and U.S.P. XVII. These gelatins are generally colorless; transparent; odorless; tasteless; absorb up to five to ten times their weight of water; are soluble in hot water, glycerol and acetic acid; and insoluble in alcohol, chloroform, and other organic solvents. These gelatins are commonly used in the manufacture of photographic films; lithography; sizing; plastic compounds; textile and paper work; foods, rubber substitutes; adhesives; cements; capsules for medicinals; artificial silk, matches; light filters; clarifying agents; bacteriology; and medicine. Typical suitable gelatins comprise any naturally occurring protein used as the binding medium for silver halide crystals in the common type of photographic emulsions, and are not limited to any particular definite chemical compound. A given sample of gelatin may contain molecules of various molecular weights ranging from about 20,000 to over 100,000, and of various amino-acid compositions. The gelatin coating is normally dissolved in water and coated over the surface of the softenable layer 13** which contains the migration marking particles. A more inclusive definition for gelatin compounds falling within the scope of this invention is set forth under the definition of "gelatin" contained in the *Focal Encyclopedia of Photography,* Vol. 1, Focal Press, London and New York, 1965, pp. 695 and 696. The thickness of the gelatin layer generally should range from about 0.01 to 1.0 microns. A preferred range of thickness which yields outstanding results is from about 0.1 to 0.5 microns. The gelatin layer may be applied by any suitable technique. The above group of materials is not intended to be limiting, but merely illustrative of materials suitable for such intermediate layers 15A.

The electrically conductive overlayer used in conjunction with the electrically insulating overlayer as described immediately above, may comprise any of the electrically conductive materials mentioned earlier above. The substantially electrically insulating overlayers suitable for use with the conductive overlayers of the present invention are typically preferably not greater than about 75 microns in thickness. Where intermediate electrically insulating layers are used, such layers should have desirable properties such as suitable flexibility. The electrically conductive overlayer may be of any suitable thickness, with practical considerations such as desired flexibility and cost playing significant roles in selection of the desired thickness. Thinner electrically conductive overcoatings typically need only be electrically continuous so that the layer has high lateral electrical conductivity.

Although conductive overlayer 15 and in the various embodiments its component overlayers 15A and 16 have been described in conjunction with a single, intact imaging member, it will be appreciated that in various embodiments the imaging member may comprise separable component parts which include a separable conductive overlayer 15 or conductive layer 16 and less electrically conductive interlayer 15A. Furthermore, in various embodiments of the advantageous imaging members of the present invention, the softenable layer, which is in contact with or contains the migration marking material may itself be of sufficient integrity to be self-supporting and may be brought in contact with a suitable substrate and with suitable conductive overlayers before or during processing in the advantageous system of the present invention.

In the migration imaging processes discussed above, the process steps typically comprise providing the migration imaging member, applying an imagewise migration force to the migration marking material of said member and developing the latently imaged member to allow an imagewise migration of the migration marking material in depth in the softenable layer toward the substrate. The imagewise migration force applied to the migration marking material is often some sort of electrical latent image. For example, electrical latent images may be produced by various modes including electrostatically charging or sensitizing with a corona charging device in image configuration through the use of a mask or stencil, or by first forming such a charge pattern on a separate layer such as a photoconductive insulating layer used in conventional xerographic reproduction techniques, and then transferring this charge pattern to the surface of a migration imaging plate by bringing the two into very close proximity and utilizing breakdown techniques as described for example in Carlson, U.S. Pat. No. 2,982,647, and Walkup, U.S. Pat. Nos. 2,825,814 and 2,937,943. In addition, charge patterns conforming to selected shaped electrodes or combinations of electrodes may be formed on a support surface by the "TESI" discharge technique, as more fully described in Schwertz, U.S. Pat. Nos. 3,023,731 and 2,919,967 or by techniques described in Walkup U.S. Pat. Nos. 3,001,848 and 3,001,849, or by induction imaging techniques, or even by electron beam recording techniques, as described in Glenn, U.S. Pat. No. 3,113,179.

The term "electrical latent image" is used to describe the latent image in the advantageous system of the present invention, and that term in the several variant forms thereof used herein include the images formed by the charge-expose mode, which images cannot readily be detected by standard electrometric techniques as an electrostatic latent image for example of the type found in xerography may be used, so that no readily detectable or at best a very small change in the electrostatic potential is found after exposure (when using preferred exposure levels); and include electrostatic latent images of a type similar to those found in xerography which are typically readily measurable by standard electrometers, that is electrostatic latent images showing surface potentials typically reading at least about 5 to 10 volts. Of course in the present invention, the presence of the electrically conductive layer 15 may remove the possibility of obtaining a detectable image, although migration imaging may still be achieved.

Figure 3A:
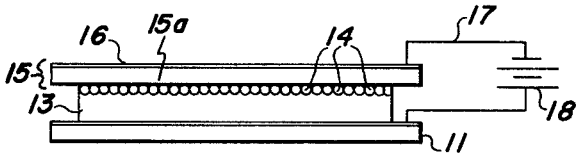
FIGS. 3(a–c) illustrate preferred process steps in the invention system in conjunction with partially schematic, cross-sectional views of an imaging member of the present invention.

In the process of the present invention as described in conjunction with FIG. 3, migration imaging processes are provided wherein the imagewise migration force acting on the migration marking material in the imaging members, is associated with electrical latent images having electrons rather than ions as the initial charges produced in the imaging system. The present invention is illustrated being charged by circuit means 17 having a source of potential difference 18 therein. Circuit 17 is electrically connected to conductive substrate 11, and on the opposite side of the marking material is electrically connected to conductive layer 15. In the alternative, conductive substrate 11 may be contacted to ground and conductive overlayer 15 electrically connected to an electrical potential. The overlayer may include an insulating layer 15A which, although the mechanism is somewhat speculative, may, upon heating, as is done during one mode of development of migration images, become sufficiently conductive to transport charge to the surface of softenable layer 13, or otherwise make charge available to the softenable layer, for example as by becoming polarized. There the conductive overlayer is illustrated as substantially insulating overlayer 15A having conductive coating 16 thereon. However, it will be appreciated that any conductive overcoating 15 will produce the same results in the inventive system. Where the photosensitivity of photosensitive material in the imaging member and particularly photosensitive marking materials is to be used, the use of the less electrically conductive layer 15A is preferably utilized. Where the substrate 11 is substantially electrically insulating, the imaging member may be placed with the insulating substrate 11 contacting a conductive plate, and circuit means 17 may be electrically connected to such a plate instead of to the substrate as illustrated in FIG. 3A. The binder structure imaging member described in FIG. 2 may be used in the process of FIG. 3 with similar results.

Figure 3B:
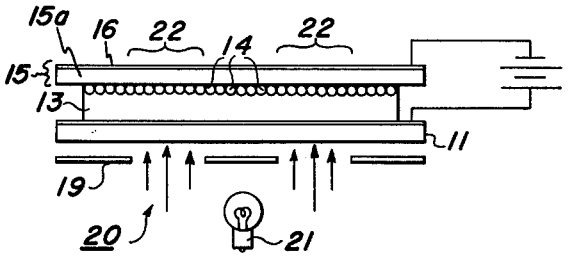

The inventive charging process illustrated in FIG. 3A provides electrons as the free charges in the system. The pattern of electrons placed upon the migration imaging member corresponds to the shape of the conductive overlayer 15. That is, electrons are made available to the migration imaging member wherever the conductive overlayer 15 contacts the softenable material or where the conductive coating 16 contacts the intermediate insulating layer 15A. In this way, it is possible to charge the entire surface, or any desired portion of the surface with an electrical latent image made up of electrons. For example, an image-shaped conductive overlayer may be used to selectively charge the member in the desired image configuration. The voltage placed across the imaging member and which is suitable for charging the imaging member in the system of the present invention may vary depending upon the thickness of the imaging member. For example, where the conductive overlayer directly contacts the imaging member, low potentials, as low as about 10 volts may be suitable, while embodiments wherein the electrically conductive overlayer is over an intermediate more insulating layer, higher potentials, even as high as about 8000 volts, may be required. Where the migration marking material 14, the softenable layer 13, on substrate 11 comprises electrically photosensitive material, the migration imaging member may be charged as described in FIG. 3A, and then exposed as shown in FIG. 3B to produce an electrical latent image upon the migration imaging member. Exposure may be carried out with or without the electrical circuit connected to the potential source. In FIG. 3B, the charged migration imaging member is shown being exposed through optical mask 19 by activating electromagnetic radiation 20 from a source of electromagnetic radiation 21, here, for example, a source of light. Where it is desirable to expose the migration imaging member to electromagnetic radiation, as described in FIG. 3B, it is seen that either the substrate 11 or the conductive overlayer 15 is preferably translucent or substantially transparent.

Figure 3C:
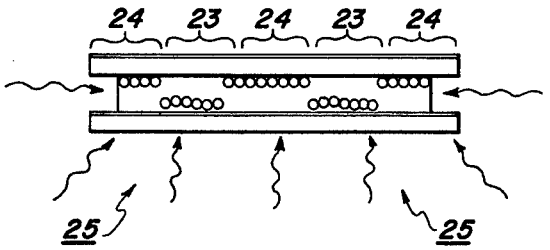

The member 10 having the electrical latent image thereon is then developed by changing the permeability of the softenable material or by otherwise reducing the resistance of the softenable material to the migration of migration marking material particles through the bulk of said softenable material. FIG. 3C for example illustrates development by the application of heat shown radiating into the softenable material at 25. The application of heat, solvent vapors, solvent liquids, or combinations thereof, or any other means for softening softenable layer 13 may be used to develop the imaged member, whereby migration marking material 14 is allowed to migrate in depth in softenable layer 13 in imagewise configuration toward the substrate 11. In FIG. 3C, the migration marking material is shown migrated in areas 24, and in its initial, unmigrated state in areas 23. It is seen that areas 23 and 24 correspond to the formation of the electrical latent image described in conjunction with FIGS. 3A and 3B. Such an imaged member may be viewed as developed as described above, split to provide complementary images on the overlayer and substrate, or further developed as, for example, by solvent wash-away development, or used for any other desired purpose.

Depending upon the specific imaging system used, including the specific imaging structure, materials, process steps, and other parameters, the advantageous imaging system of the present invention may produce positive images from positive originals or negative originals from positive originals.

Figure 4:
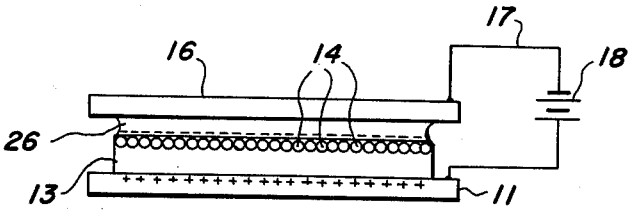
FIG. 4 is a partially schematic, cross-sectional view of the charging method of the present invention wherein an insulating liquid layer is used between the conductive charging member and the imaging member.

Another embodiment of the advantageous system of the present invention is illustrated in FIG. 4 wherein an insulating liquid layer 26 is used between the conductive charging member 15 and the migration imaging member 10. In other respects, the system illustrated in FIG. 4 is substantially idential to the one illustrated and described in conjunction in conjunction with FIG. 3A. Insulating liquids suitable for use in such embodiments include Dow Corning 200 silicone fluids with viscosity ranging from less than 1 centistoke to more than 1000 centistokes. Other silicone oils such as dimethylpolysiloxanes and very high boiling point long chain aliphatic hydrocarbon oils ordinarily used as transformer oils such as Wemco-C transformer oil available from Westinghouse Electric Company. Any suitable volatile or non-volatile liquid may be employed. Others include carbon tetrachloride, petroleum ether, Freon 214 (tetrafluorotetrachloropropane), Sohio Odorless Solvent 3440, other halogenated hydrocarbons such as methylenechloride, trichlorethylene, perchloroethylene, chlorobenzene, trichloromonofluoromethane, tetrachlorodifluoroethane. In addition, ethers such as diethyl ether, diisopropyl ether, dioxane, tetrahydrofuran, ethyleneglycol monoethyl ether, aromatic and aliphatic hydrocarbons such as benzene, toluene, xylene, hexane, chlorohexane, mineral oil, vegetable oil, melted waxes, paraffins, and mixtures thereof. Furthermore, less electrically insulating interlayer 15A may comprise a material similar to the materials used for softenable layer 13, which materials are softened prior to charging, or which are soft under ambient conditions. The above group of materials is not intended to be limiting, but merely illustrative of materials suitable for liquid layer 26. The liquid layer may be of any suitable thickness, with layers of thickness not greater than about 75 microns being preferred.

The insulating liquid may be confined in a desired image configuration in some embodiments. Furthermore, where charges are supplied to the imaging member in an imagewise charge pattern, even more conductive liquids may be used with or without a conductive layer over the entire surface of the liquid layer.

Figure 5:
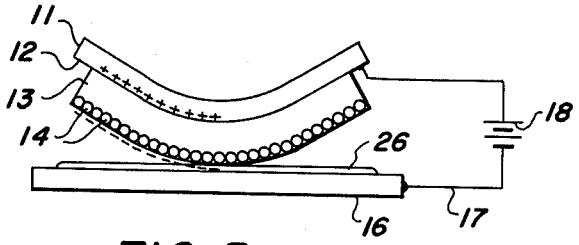
FIG. 5 is a partially schematic, cross-sectional view of the charging method of the present invention wherein the conductive charging member is overcoated with an insulating liquid layer and the imaging member is rolled into contact therewith.

FIG. 5 illustrates another embodiment similar to the one illustrated in FIG. 4, however, here the conductive charging member 16 has the insulating fluid layer 26 placed directly upon the surface of the charging member, and the migration imaging member 10 is brought into contact with the fluid coated plate thereby charging the imaging member.

Figure 6:
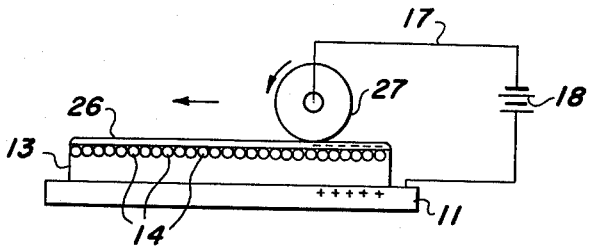
FIG. 6 is a partially schematic, cross-sectional view of the charging method as illustrated in FIG. 4, except the conductive charging member is an electrically conductive roller.

In still another embodiment of the advantageous system of the present invention, the charging member may be in the form of a conductive roller or cylinder as illustrated as conductive member 27 in FIG. 6. Such a conductive roller or cylinder may be passed across the surface of the imaging member itself, in actual contact with the surface of softenable layer 13, or the imaging member may be brought into contact with the conductive roller. Alternately, the imaging member may be coated with insulating fluid layer 26, and the conductive roller charging member 27, may be contacted to the liquid coated imaging member and passed across the surface thereof thereby charging said member.

It will be appreciated that in the methods described in conjunction with FIGS. 4, 5, and 6, as well as the methods described in FIG. 3, that the inventive system lends itself to simultaneous charging and exposing of imaging members where the imaging members comprise electrically photosensitive material, and in further embodiments imaging members may even be simultaneously charged, exposed and developed simultaneously. For example, exposure may take place through substantially transparent substrate materials 11 or through substantially transparent conductive overlayers 15, as well as through transparent insulating fluid layers 26, while the imaging member is being charged by the advantageous system of the present invention. In a still further embodiment, the conductive charging roll 27 illustrated in FIG. 6 may itself be substantially transparent, and an exposure system may be an internal part of charging roll member 27, and simultaneously expose an electrically photosensitive imaging member while said member is being charged by passing in contact with the charging roll 27. Or, where the charging is performed in imagewise fashion, the imaging member may also be simultaneously developed.

The following examples further specifically define the present invention wherein conductively overcoated migration imaging members are used in conjunction with novel migration imaging systems. The parts and percentages are by weight unless otherwise indicated. The examples below are intended to illustrate various preferred embodiments of the novel migration imaging system.

EXAMPLE I

A conductively overcoated imaging member suitable for use in the advantageous system of the present invention is prepared by providing an aluminized Mylar substrate, a polyester resin film available from duPont overcoated with a semi-transparent layer of conductive aluminum, and coating upon the aluminized side of the Mylar substrate an about 2 micron softenable layer of custom synthesized copolymer of styrene and hexylmethacrylate and a fracturable layer of selenium comprising particles of average diameter of about 0.3 microns, is vacuum evaporated onto the softenable layer. A second layer of aluminized Mylar, the Mylar portion being about 6 microns thick, is placed with the Mylar in contact with the softenable layer and/or fracturable layer. This structure is then charged either positively or negatively by momentarily connecting the conductive aluminum overcoating on the substrate and conductive overcoating of the Mylar overlayer to the opposite terminals of an about 500 volt power supply for about 1 second. This charges the structure to a surface potential of about 480 volts. This charged structure is then exposed to a light-and-shadow image pattern of about 1 f.c.s. exposure from a tungsten lamp and then heated for about 5 seconds at about 100° C. The selenium particles in the exposed areas migrate in depth in the softenable layer, which is softened at this increased temperature, toward the substrate to produce a visual image.

EXAMPLE II

A conductively overcoated imaging member is imaged as described in Example I and the charging voltage is maintained across the imaging member throughout the development step to produce a resultant image similar to the one produced in Example I.

EXAMPLE III

A conductively overcoated imaging member as described in Example I is overcoated with a layer of aluminized Mylar, the Mylar base portion thereof which is in contact with the softenable layer of the migration imaging member, being about 75 microns in thickness. This member is charged using a source of potential of about 6000 volts and then exposed to about 10 ergs/cm of about 4000 Angstrom wavelength light. The image produced in this way is similar to the one produced in Example I.

EXAMPLE IV

A conductively overcoated imaging member as described in Example I is provided wherein the substrate of said member is an about 7 micron layer of Mylar (not aluminized as described in Example I). This imaging member is charged by placing the insulating Mylar substrate on a stainless steel electrode which is then connected to a charging circuit as the aluminized Mylar substrate was in Example I. An about 1000 volt source of potential is used in the charging circuit, and the member is developed to produce an image as described in Example I.

EXAMPLE V

A conductively overcoated imaging member is provided using the aluminized Mylar substrate, the softenable layer comprising the copolymer of styrene and hexylmethacrylate and fracturable layer of selenium as described in Example I, and this imaging member is further overcoated with an about 2 micron layer of the same softenable material, the custom synthesized copolymer of styrene and hexylmethacrylate. This coated imaging member is then overcoated with the conductive aluminized Mylar of Example I. This imaging member is charged in the system described in Example I using an about 1000 volt source of potential difference in the charging circuit. The member is developed as described in Example I to produce a similar imaged member.

EXAMPLE VI

A conductively overcoated imaging member is provided on a substantially insulating Mylar substrate by providing a dispersion of graphite particles not greater than about 1 micron in diameter in a matrix of paraffin (Bioloid Paraffin Embedding Compound from Will Corp., melting point 53-55° C.). This paraffin-graphite matrix is coated upon the insulating substrate to a thickness of about 6 microns. On the surface of this binder layer matrix, a thin metal conductive layer in imagewise configuration is placed, and the insulating substrate is placed on a stainless steel electrode. The stainless steel electrode and the imagewise conducting overlayer are electrically connected to the charging circuit having a source of potential difference of about 200 volts therein. The charged member is then heated for a few seconds at about 55° C. to soften the layer of softenable material, and graphite particles in the charged areas migrate in depth in the softenable material toward the substrate thereby providing a migration image.

EXAMPLE VII

An imaging member is prepared by vacuum evaporating an about 0.2 micron layer of selenium on an about 2 micron softenable layer of Piccotex 100, a substituted styrene copolymer resin available from the Pennsylvania Industrial Chemical Co., the softenable layer overlying a supporting substrate of aluminized Mylar, a polyester resin film available from duPont overcoated with a semi-transparent layer of conductive aluminum. This imaging member is charged by rolling the softenable layer face of the imaging member against a brass plate covered with a thin layer of Dow Corning 200 silicon fluid, 0.65 centistoke grade, with a voltage applied between the aluminized Mylar substrate and the brass plate, thereby electrostatically charging the imaging member to a potential of about 40 volts. The charged imaging member is then exposed to an optical image of energy of about $1.5 \times 10^{11}$ photons per square centimeter in the illuminated areas, by means of an about 4000 Angstrom unit wavelength light source, and the latently imaged member is developed by immersing it in a bath of cyclohexane for about 2 seconds. A high contrast replica of the optical image results in the imaged member.

EXAMPLE VIII

An imaging member as described in Example I is charged by rolling it against a brass plate covered with a layer of Dow Corning 200 silicone fluid, 0.65 centistoke grade, with a voltage applied between the aluminized Mylar substrate of the imaging member and the brass plate to electrically charge the imaging member to a surface potential of about −80 volts. The plate is then exposed and developed as described in Example I.

Although specific components and proportions have been stated in the above description of the preferred embodiments of the novel migration imaging system wherein conductively overcoated migration imaging members are used, other suitable materials and variations in the various steps in the system as listed herein, may be used with satisfactory results and various degrees of quality. For example, migration imaging members may be made more sensitive or particularly sensitive to exposure to activating electromagnetic radiation in the x-ray range by including fluorescent materials within the migration imaging members themselves. For example, fluorescent particles or fluorescent materials may be included in migration marking material, in the softenable material, or in the substrate material. Upon exposure with x-rays, the fluorescent materials fluoresce thereby exposing any other electrically photosensitive portions of the imaging member which may require activating electromagnetic radiation of wavelength comparable to the wavelength of the radiation eminating from the fluorescent materials. X-ray exposure using fluorescent materials is well known in related imaging arts as disclosed for example, in Metcalfe et al U.S. Pat. No. 3,210,543, Kostlec et al U.S. Pat. No. 2,940,848, Vyverberg, U.S. Pat. No. 2,856,535, and DeHart U.S. Pat. No. 3,444,372. In another similar system, migration imaging films may be exposed by using electrically photosensitive migration imaging members with intensifying fluorescent screens which may be used with any suitable activating electromagnetic radiation input, including x-ray exposure. X-ray exposure of migration imaging members, also opens up x-ray ionography as a method of charging a migration imaging member. An imagewise pattern of x-rays penetrating air between an electrode and the migration imaging member may have the effect of ionizing the air in the space between the electrode and the imaging member and thereby forming a charge pattern on the migration imaging member itself, and this charge pattern may be suitable as an electrical latent image which is a migration force suitable for use in the migration imaging system of the present invention. In addition, other materials and steps may be added to those used herein and variations may be made in the process to synergize, enhance or otherwise modify the properties of or increase the uses for the invention.

It will be understood that various other changes of the details, materials, steps, arrangements of parts and uses which have been herein described and illustrated in order to explain the nature of the invention will occur to and may be made by those skilled in the art upon a reading of this disclosure, and such changes are intended to be included within the principal and scope of this invention.

What is claimed is:

1. An imaging process comprising:

providing an imaging member comprising a substrate, a substantially electrically insulating softenable layer, a fracturable layer of migration marking material contiguous the surface of and contacting the softenable layer spaced apart from the substrate, said softenable layer capable of having its resistance to migration of migration marking material decreased sufficiently to allow migration of migration marking material in depth in said softenable material, and providing an electically conductive member contacting the surface of said softenable layer spaced apart from the substrate; either said conductive member of said substrate and said softenable layers being at least partially transparent to said activating electromagnetic radiation set forth below;

electrically latently imaging said imaging member by imagewise exposing said member through the transparent side thereof to activating electromagnetic radiation and electrically connecting said electrically conductive member to a first electrical potential and contacting the substrate to ground or to an electrical potential different from the first electrical potential, said imagewise exposure and electrically connecting steps being substantially simultaneous, and developing said imaged member by decreasing the resistance to migration of migration marking material in depth in said softenable layer, said development step occurring after said imagewise exposure begins.

2. The process of claim 1 wherein the softenable layer is of a thickness in the range between about ½ and about 16 microns, and the migration marking material is of average particle size not greater than about 2 microns.

3. The process of claim 1 wherein said fracturable layer is of a thickness in the range between about 0.01 microns and about 2 microns.

4. The process of claim 1 wherein said substrate is sufficiently transparent to transmit activating electromagnetic radiation.

5. The process of claim 1 wherein said electrically conductive member is sufficiently transparent to transmit activating electromagnetic radiation.

6. The process of claim 1 wherein said substrate is electrically conductive.

7. The process of claim 1 wherein said substrate is substantially electrically insulating and said member is electrically latently imaged while said insulating substrate is substantially everywhere contacting a conductive member which is electrically grounded or electrically connected to the opposite pole of the source of electrical potential.

8. The process of claim 1 wherein the imaging member comprising the substrate, softenable layer and migration marking material comprises electrically photosensitive material.

9. The process of claim 8 wherein said migration marking material comprises electrically photosensitive material.

10. The process of claim 8 wherein the softenable layer comprises electrically photosensitive softenable material.

11. The process of claim 1 wherein the electrically conductive member comprises a composite member comprising an electrically conductive member overlying a layer of material which is more insulating than the electrically conductive portion of the composite member, and said more insulating layer contacts the surface of the softenable layer.

12. The process of claim 11 wherein said more insulating layer is of a thickness not greater than about 75 microns.

13. The process of claim 11 wherein said more insulating layer comprises an insulating liquid.

14. The process of claim 1 wherein the electrically conductive member is in a shape corresponding to the desired electrical latent image.

15. The process of claim 1 wherein said softenable layer and said supporting substrate are separate members and are brought into contact with each other.

16. The process of claim 1 wherein said softenable layer and said conductive member are separate members and are brought into contact with each other.

17. The process of claim 13 wherein said electrically conductive member is coated with said liquid layer, the surface of the softenable layer is brought into contact with said liquid layer and then separated from said liquid layers.

18. An imaging process comprising:

providing an imaging member comprising a substrate, a substantially electrically insulating softenable layer containing migration marking material, said softenable layer capable of having its resistance to migration of migration marking material decreased sufficienty to allow migration of migration marking material in depth in said softenable material, and providing an electrically conductive member contacting the surface of said softenable layer spaced apart from the substrate, either said conductive member or said substrate and softenable layers being at least partially transparent to said activating electromagnetic radiation set forth below;

electrically latently imaging said imaging member by imagewise exposing said member through the transparent side thereof to activating electromagnetic radiation and electrically connecting said electrically conductive member to a first electrical potential and contacting the substrate to ground or to an electrical potential different from the first electrical potential, said imagewise exposure and electrically connecting steps being substantially simultaneous, and developing said imaged member by softening said softenable layer at least sufficient to allow imagewise migration of migration marking material at least in depth in said softenable layer.

19. An imaging process comprising:

providing an imaging member comprising a substrate, a substantially electrically insulating softenable layer containing migration marking material, said softenable layer capable of having its resistance to migration of migration marking material decreased sufficiently to allow migration of migration marking material in depth in said softenable material, and providing an electrically conductive member contacting the surface of said softenable layer spaced apart from the substrate; either said conductive member or said substrate and said softenable layers being at least partially transparent to said activating electromagnetic radiation set forth below;

electrically latently imaging said imaging member by imagewise exposing said member through the transparent side thereof to activating electromagnetic radiation and electrically connecting said electrically conductive member to a first electrical potential and contacting the substrate to ground or to an electrical potential different from the first electrical potential, said imagewise exposure and electrically connecting steps being substantially simultaneous, and developing said imaged member by removing the softenable material and unmigrated material by contacting the imaged member with a solvent liquid which dissolves said softenable layer and washes away said unmigrated material, said development step occurring after said imagewise exposure begins.

20. The imaging process of claim 1 wherein the resistance to migration is decreased by softening said softenable layer at least sufficient to allow imagewise migration of migration marking material at least in depth in said softenable layer.

21. The imaging process of claim 1 wherein the resistance to migration is decreased by applying a liquid solvent to said softenable layer which removes the softenable material and unmigrated material, and dissolves said softenable layer and washes away the unmigrated material.

22. The process of claim 18 wherein said migration marking material initially comprises a fracturable layer contiguous and contacting the surface of the softenable layer spaced apart from the substrate.

23. The process of claim 22 wherein said fracturable layer is of a thickness in the range between about 0.01 micron and about 2 microns.

24. The process of claim 18 wherein the migration marking material is initially dispersed throughout said softenable layer.

25. The process of claim 18 wherein said substrate is sufficiently transparent to transmit activating electromagnetic radiation.

26. The process of claim 18 wherein said electrically conductive member is sufficiently transparent to transmit activating electromagnetic radiation.

27. The process of claim 18 wherein said substrate is electrically conductive.

28. The process of claim 18 wherein said substrate is substantially electrically insulating and said member is electrically latently imaged while said insulating substrate is substantially everywhere contacting a conductive member which is electrically grounded or electrically connected to the opposite pole of the source of electrical potential.

29. The process of claim 18 wherein the imaging member comprising the substrate, softenable layer and migration marking material comprises electrically photosensitive material.

30. The process of claim 29 wherein said migration marking material comprises electrically photosensitive material.

31. The process of claim 29 wherein the softenable layer comprises electrically photosensitive softenable material.

32. The process of claim 18 wherein the electrically conductive member comprises a composite member comprising an electrically conductive member overlying a layer of material which is more insulating than the electrically conductive portion of the composite member, and said more insulating layer contacts the surface of the softenable layer.

33. The process of claim 32 wherein said more insulating layer is of a thickness not greater than about 75 microns.

34. The process of claim 32 wherein said more insulating layer comprises an insulating liquid.

35. The process of claim 18 wherein said softenable layer and said conductive member are separate members and are brought into contact with each other.

36. The process of claim 34 wherein said electrically conductive member is coated with said liquid layer, the surface of the softenable layer is brought into contact with said liquid layer and then separated from said liquid layers.

37. The process of claim 19 wherein the softenable layer is of a thickness in the range between about ½ and about 16 microns, and the migration marking material is of average particle size not greater than about 2 microns.

38. The process of claim 19 wherein said migration marking material initially comprises a fracturable layer contiguous and contacting the surface of the softenable layer spaced apart from the substrate.

39. The process of claim 38 wherein said fracturable layer is of a thickness in the range between about 0.01 microns and about 2 microns.

40. The process of claim 19 wherein the migration marking material is initially dispersed throughout said softenable layer.

41. The process of claim 19 wherein said substrate is sufficiently transparent to transmit activating electromagnetic radiation.

42. The process of claim 19 wherein said electrically conductive member is sufficiently transparent to transmit activating electromagnetic radiation.

43. The process of claim 19 wherein said substrate is electrically conductive.

44. The process of claim 19 wherein said substrate is substantially electrically insulating and said member is electrically latently imaged while said insulating substrate is substantially everywhere contacting a conductive member which is electrically grounded or electrically connected to the opposite pole of the source of electrical potential.

45. The process of claim 19 wherein the imaging member comprising the substrate, softenable layer and migration marking material comprises electrically photosensitive material.

46. The process of claim 45 wherein said migration marking material comprises electrically photosensitive material.

47. The process of claim 45 wherein the softenable layer comprises electrically photosensitive softenable material.

48. The process of claim 19 wherein the electrically conductive member comprises a composite member comprising an electrically conductive member overlying a layer of material which is more insulating than the electrically conductive portion of the composite member, and said more insulating layer contacts the surface of the softenable layer.

49. The process of claim 48 wherein said more insulating layer is of a thickness not greater than about 75 microns.

50. The process of claim 48 wherein said more insulating layer comprises an insulating liquid.

51. The process of claim 19 wherein said softenable layer and said supporting substrate are separate members and are brought into contact with each other.

52. The process of claim 19 wherein said softenable layer and said conductive member are separate members and are brought into contact with each other.

53. The process of claim 50 wherein said electrically conductive member is coated with said liquid layer, the surface of the softenable layer is brought into contact with said liquid layer and then separated from said liquid layers.

* * * * *